US009283769B2

(12) United States Patent
Butler

(10) Patent No.: US 9,283,769 B2
(45) Date of Patent: Mar. 15, 2016

(54) SELF-CLEANING THERMAL MEDIA AND METHODS OF MANUFACTURING THEREOF

(71) Applicant: NCR Corporation, Duluth, GA (US)

(72) Inventor: Jerry Butler, Morristown, TN (US)

(73) Assignee: NCR Corporation, Duluth, GA (US)

( * ) Notice: Subject to any disclaimer, the term of this patent is extended or adjusted under 35 U.S.C. 154(b) by 0 days.

(21) Appl. No.: 13/873,884

(22) Filed: Apr. 30, 2013

(65) Prior Publication Data

US 2014/0320583 A1 Oct. 30, 2014

(51) Int. Cl.

| | |
|---|---|
| ***B41J 2/165*** | (2006.01) |
| ***B41J 2/32*** | (2006.01) |
| ***B41M 5/42*** | (2006.01) |
| ***B41J 29/17*** | (2006.01) |

(52) U.S. Cl.

CPC .. *B41J 2/32* (2013.01); *B41J 29/17* (2013.01); *B41M 5/42* (2013.01); *B41M 5/423* (2013.01); *B41M 2205/04* (2013.01); *B41M 2205/40* (2013.01)

(58) Field of Classification Search

None

See application file for complete search history.

(56) References Cited

U.S. PATENT DOCUMENTS

| | | | | |
|---|---|---|---|---|
| 2005/0128280 | A1 * | 6/2005 | Johnson et al. | 347/187 |
| 2007/0056126 | A1 * | 3/2007 | Muhr-Sweeney | 15/104.001 |
| 2013/0260991 | A1 * | 10/2013 | Van Boom et al. | 503/200 |

* cited by examiner

*Primary Examiner* — Alejandro Valencia

(74) *Attorney, Agent, or Firm* — Michael Chan; Schwegman, Lundberg & Woessner

(57) ABSTRACT

Thermal media comprises a substrate having a front side and a back side opposite the front side. The thermal media also comprises a thermally-sensitive coating disposed on the front side of the substrate. The thermal media further comprises a cleaner material disposed on a portion of the thermally-sensitive coating. The cleaner material is integrated into the thermally-sensitive coating to perform cleaning of a thermal print head when the cleaner coating moves past the thermal print head.

20 Claims, 4 Drawing Sheets

SELF-CLEANING THERMAL MEDIA AND METHODS OF MANUFACTURING THEREOF

BACKGROUND

The present application relates to thermal media such as thermal paper rolls or thermal label rolls, and is particularly directed to self-cleaning thermal media and methods of manufacturing thereof.

A typical thermal paper roll 10 is shown in FIGS. 1 and 2. The thermal paper roll 10 comprises a continuous web 12 of material wound in a spiral around a core 14. The web 12 includes a substrate 16 (FIG. 2) having a front side 18 and a back side 20 opposite the front side. A thermal-sensitive coating 26 is disposed on the front side 18 of the substrate 16, and extends along a longitudinal running axis 24 (FIG. 1) of the web 12.

During use of the thermal paper roll 10 of FIGS. 1 and 2, the thermal paper roll is fed past a thermal print head of a direct thermal printer (not shown). The thermal print head provides heat to thermally image portions of the thermal-sensitive coating layer 26 to provide information, such as receipt information, on the thermally-imaged portions. A movable cutting blade of the printer then cuts the web 12 in cross-section at a location along the longitudinal running axis 24 to provide a printed receipt. Alternatively, the web 12 may be cut in cross-section by a user manually tearing it against a stationary cutting blade of the printer to provide a printed receipt.

Each time the thermal print head applies heat to thermally image portions of the thermal-sensitive coating layer 26, some residue is left behind on the thermal print head. This reduces the print quality of receipts as residue builds up over time on the thermal print head. In addition, the thermal paper roll 10 may produce a large amount of dust which can build up over time on the thermal print head. This also reduces the print quality of receipts as dust builds up over time on the thermal print head.

The buildup of residue and dust on the thermal print head requires an off-line cleaning regiment to be periodically followed in order to maintain print quality. Known cleaning regiments typically use separate cleaning supplies, and may use cleaning instruments such as cleaning cards and cleaning pens. A drawback in using known cleaning regiments is that compliance with these cleaning processes is difficult to enforce. It would be desirable to provide a way of cleaning a thermal print head and ensuring compliance with the cleaning process.

SUMMARY

In accordance with one embodiment, thermal media comprises a substrate having a front side and a back side opposite the front side, a thermally-sensitive coating disposed on the front side of the substrate, and a cleaner material disposed on a portion of the thermally-sensitive coating, wherein the cleaner material is integrated into the thermally-sensitive coating to perform cleaning of a thermal print head when the cleaner coating moves past the thermal print head.

In accordance with another embodiment, self-cleaning thermal media comprises a core, and a web having a longitudinally-extending axis and wound on the core along the axis, the web including (i) a substrate having a front side and a back side opposite the front side, (ii) a thermally-sensitive coating disposed on the front side of the substrate, and (iii) a cleaner material disposed on a portion of the thermally-sensitive coating, wherein the cleaner material functions to perform self-cleaning of a thermal print head, without using separate materials, when the cleaner material moves past the thermal print head.

In accordance with yet another embodiment, a method is provided of manufacturing self-cleaning thermal media. The method comprises applying a thermally-sensitive coating on a front side of the substrate, and applying a cleaner material on a portion of the thermally-sensitive coating such that the cleaner material performs self-cleaning of a thermal print head when the cleaner material moves past the thermal print head.

DETAILED DESCRIPTION

Figure 1:
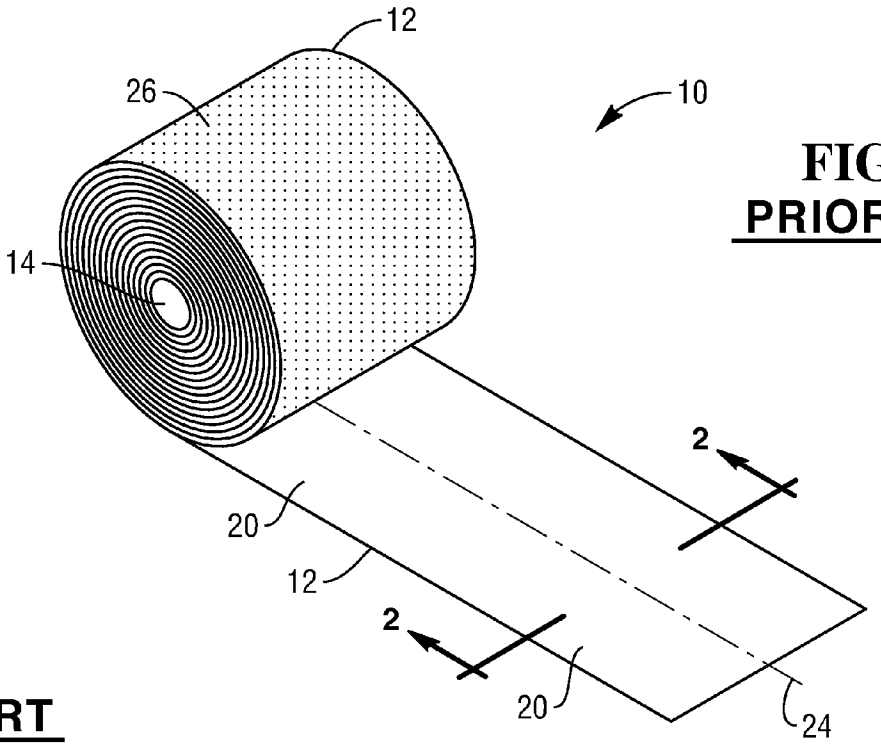
FIG. 1 PRIOR ART
FIG. 1 is a perspective view of a known thermal paper roll.
Figure 2:
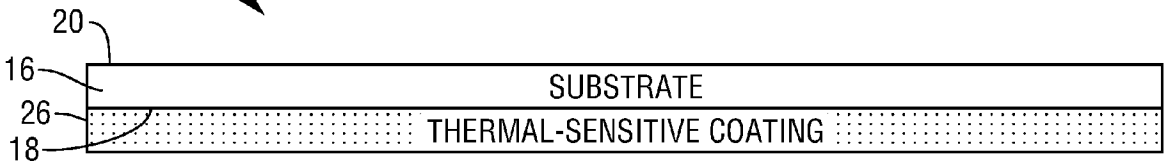
FIG. 2 PRIOR ART
FIG. 2 is a cross-sectional view, taken approximately along line 2-2 shown in FIG. 1, and showing layers of material of the known thermal paper roll.
Figure 3:
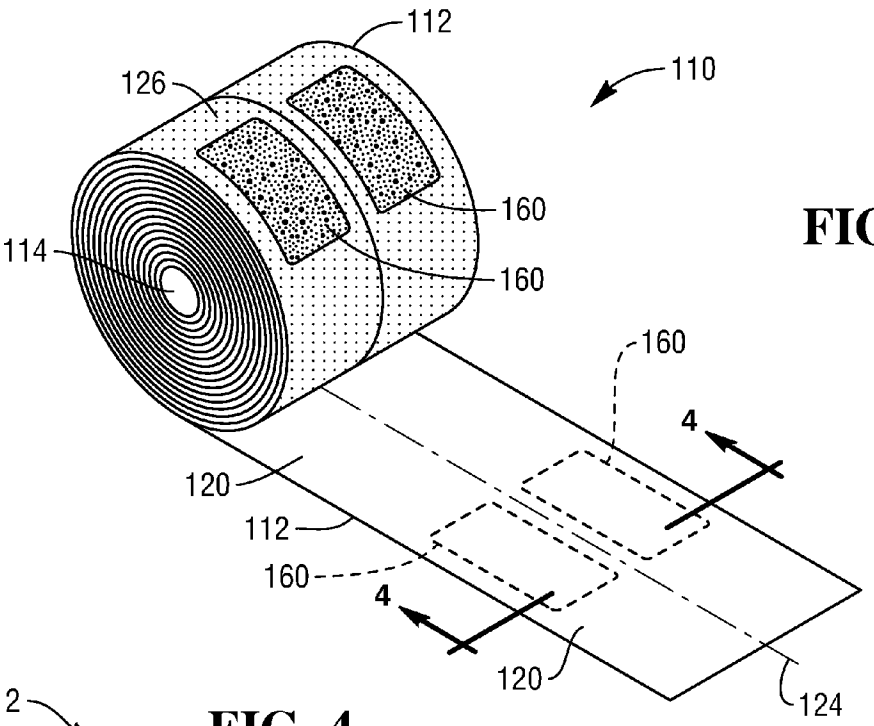
FIG. 3 is a perspective view similar to the perspective view of FIG. 1, and showing a thermal paper roll constructed in accordance with one embodiment.
Figure 4:
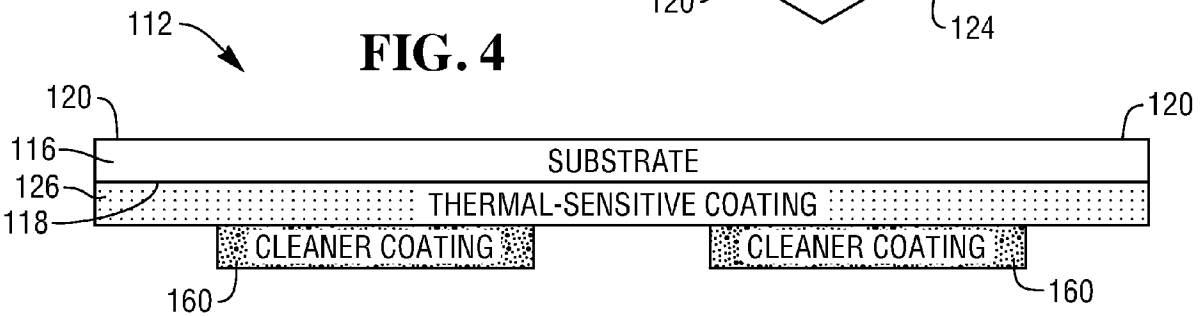
FIG. 4 is a cross-sectional view, taken approximately along line 4-4 shown in FIG. 3, and showing layers of material of the thermal paper roll.

The present application is directed to self-cleaning thermal media and methods of manufacturing thereof. Referring to FIGS. 3 and 4, example thermal paper roll 110 includes a web 112 of material having a longitudinally-extending axis 124 along a longitudinally-running direction of the web. The web 112 of material is wound on core 114 along web axis 124. Web 112 includes a substrate 116 (FIG. 4) having front side 118 and back side 120 opposite the front side. Thermally-sensitive coating 126 is disposed on an area covering front side 118 of substrate 116.

Cleaner material 160 in the form of a coating is disposed on a portion of the thermally-sensitive coating 126. Cleaner material 160 may be located in a number of different positions on the thermal paper roll 110. For illustrative purposes, two pairs of strips of cleaner material 160 are shown in FIG. 3. One of the pairs of strips of cleaner material 160 is shown in cross-section in FIG. 4. Although cleaner coating 160 is shown in FIG. 4 as comprising two separate strips of material, it is conceivable that cleaner coating 160 may comprise a single strip of material or more than two separate strips of material. For example, cleaner material 160 may comprise a single strip of material which extends between the two side edges of thermal paper roll 110.

Cleaner coating 160 is integrated into thermal paper roll 110 to perform cleaning of a thermal print head when cleaner coating moves past the thermal print head. Cleaner material 160 may comprise any combination of materials. In some embodiments, cleaner material 160 may comprise an adhesive material which provides tack to remove buildup of residue and dust from a thermal print head to clean the thermal print head. In some embodiments, cleaner material 160 may comprise an abrasive material, such as silica, which scrubs buildup of residue and dust from a thermal print head to clean the thermal print head. In some embodiments, cleaner material 160 may comprise a material which attracts dust.

In some embodiments, cleaner material 160 may comprise a high caliper material which increases pressure on the thermal paper roll 110 to provide a cleaning action on a thermal print head when the high caliper material moves past the thermal print head. The high caliper material may comprise an expandable material which expands in response to application of heat or pressure, for examples. For example, heat may be applied to expandable thermoplastic beads to increase caliper of the beaded material from a first predetermined thickness to a second predetermined thickness which is greater than the first predetermined thickness and thereby to provide a cleaning action of a thermal print head as the thermoplastic beads move past the thermal print head.

In some embodiments, cleaner material 160 may comprise a high surface tension material with a high contact angle to attract buildup from a thermal print head to clean the thermal print head. As an example, the high surface tension material may comprise a thermoplastic or rubber material which has been screened or otherwise patterned to provide a cleaning action on a thermal print head. Patterns can be applied in various designs in order to optimize cleaning results for different printing conditions such as chevron, diagonal, and block, for examples.

In some embodiments, cleaner material 160 may comprise a microencapsulated material. As an example, the microencapsulated material may comprise isopropyl alcohol (IPA). As another the microencapsulated material may comprise D-limonene. Chemical structure and composition of IPA and D-limonene are known and, therefore, will not be described.

In some embodiments, cleaner material 160 may comprise microencapsulated capsules which deliver cleaning chemicals to a thermal print head to clean the thermal print head when heat is applied to the microencapsulated capsules. Alternatively, or in addition to, cleaner material 160 may comprise microencapsulated capsules which deliver cleaning chemicals to a thermal print head to clean the thermal print head when pressure is applied to the microencapsulated capsules. The released cleaning chemicals remove dust and polymeric buildup.

In some embodiments, cleaner material 160 may comprise nanoparticles which provide an optimized cleaning surface against which a thermal print head can be cleaned. For examples, the nanoparticles may comprise at least one of silica nanomaterials, carbonate-based nanomaterials, and carbon nanotubes. Chemical structure and composition of silica nanomaterials, carbonate-based nanomaterials, and carbon nanotubes are known and, therefore, will not be described.

There are a number of different ways in which thermal paper roll 110 can be manufactured with cleaner material 160. One way is to spray a coating of cleaner material using either a standard coating technique or a specialized coating technique. Cleaner material may be sprayed at one or more locations throughout the thermal paper roll 110. The material sprayed on may be abrasive, contain special chemicals and/or possess other special properties to facilitate the cleaning process.

Figure 5:
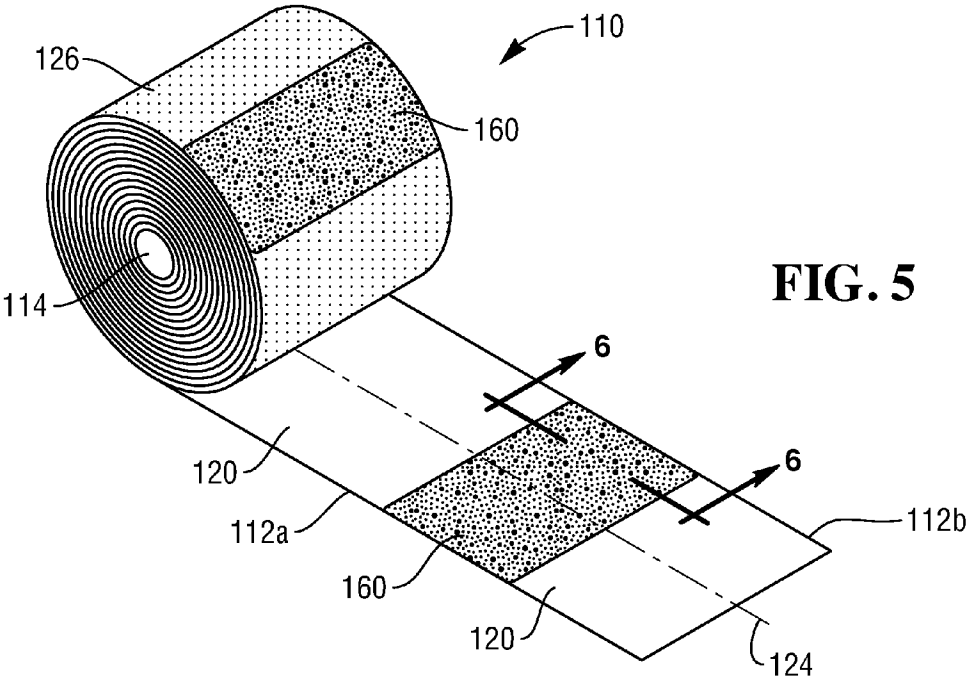
FIG. 5 is a perspective view similar to the perspective view of FIG. 3, and showing a thermal paper roll constructed in accordance with another embodiment.
Figure 6:
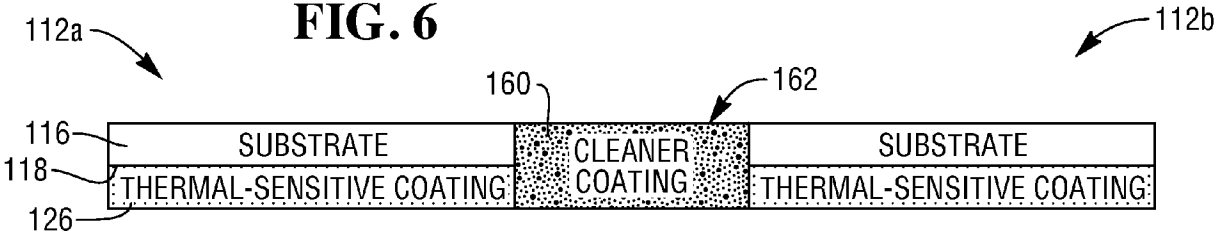
FIG. 6 is a cross-sectional view, taken approximately along line 6-6 shown in FIG. 5, and showing layers of material of the thermal paper roll.

Another way to manufacture thermal paper roll 110 with cleaner material 160 is to splice in a leader (or a trailer) of the cleaner material. For example, as shown in FIGS. 5 and 6, a section 162 of cleaner material 160 is spliced between first portion 112*a* and second portion 112*b* of thermal paper roll 110. Section 162 of cleaner material 160 may comprise a conventional cleaning card, for example. The section 162 of cleaner material 160 may be spliced by adding a splicer to a roll slitting machine. It is also conceivable that a spraying facility may be added to a roll slitting machine. Roll slitting machines and techniques of splicing section 162 of cleaner material 160 between first and second portions 112*a*, 112*b* of thermal paper roll 110 are known and, therefore, will not be described.

Still another way to manufacture thermal paper roll 110 with cleaner material 160 is to add materials to printed warning stripe (not shown) of thermal paper roll 110 in order to increase the abrasion or to deliver chemicals to the cleaning process.

Yet another way to manufacture thermal paper roll 110 with cleaner material 160 is to coat the core 114 with a chemical that impregnates inner layers of the web 112 over time to properly position the cleaning chemicals. Example chemicals to impregnate inner paper wraps include D-limonene, mineral spirit (aliphatic hydrocarbon solvent), aromatic 150, alpha and beta pinene (pine-sol), or xylene.

During use of example thermal paper roll 110 of FIGS. 3 and 4, a direct thermal printer (not shown) thermally images portions of thermal-sensitive coating 126 to provide receipt information on the thermally-imaged portions. A movable cutting blade of the printer then cuts web 112 in cross-section to provide a printed receipt. Alternatively, web 112 may be cut in cross-section by a user manually tearing it against a stationary cutting blade of the printer to provide a printed receipt.

Although the above description describes thermal paper roll 110 having all features described, it is conceivable that the thermal paper roll 110 may have any combination of the features. It is also conceivable that the thermal paper roll 110 be either a single-sided thermal paper roll or a dual-sided thermal paper roll.

Moreover, it is conceivable that the above-described features be provided in thermal rolls which are other than thermal paper rolls. As an example, any combination of the above-described features may be provided in either thermal label rolls or individual labels. As another example, any combination of the above-identified features may be provided in a linerless label roll. Any size of labels and any size of rolls are possible.

Figure 7:
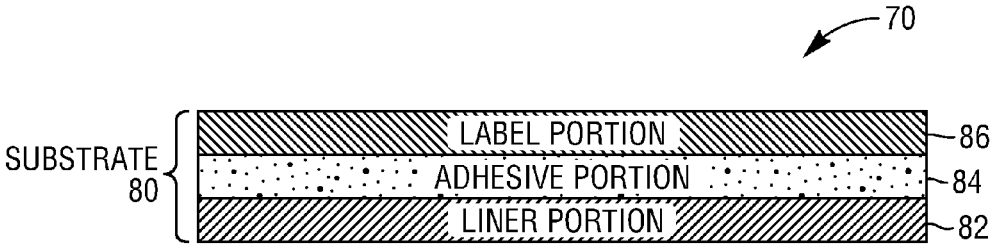
FIG. 7 PRIOR ART
FIG. 7 is a cross-sectional view of a known individual thermal label of a thermal label roll, and showing layers of material of the known thermal label.

A known individual thermal label 70 from a thermal label roll is shown in FIG. 7. Label 70 has substrate 80 which includes liner portion 82, adhesive portion 84, and label portion 86. A thermal label printer can print information onto label portion 86 to provide a finished label in known manner.

Figure 8:
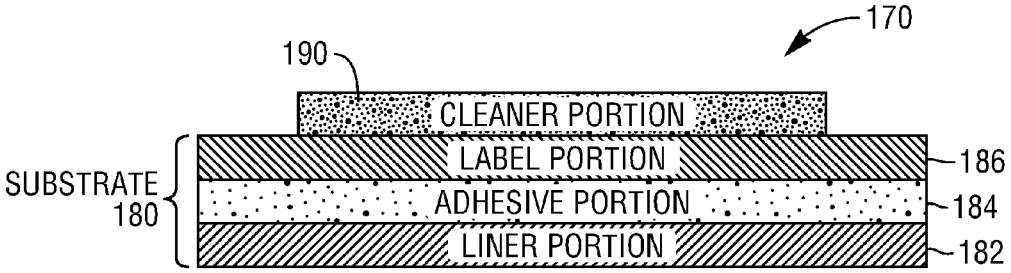
FIG. 8 is a cross-sectional view similar to the cross-sectional view of FIG. 7, and showing layers of material of an individual thermal label of a thermal label roll constructed in accordance with an embodiment.

An individual label 170 from a thermal label roll constructed in accordance with an embodiment is shown in FIG. 8. Individual label 170 has substrate 180 which includes liner portion 182, adhesive portion 184, label portion 186, and cleaner portion 190 disposed on at least a portion of label portion 186. A thermal label printer can print information onto label portion 186 to provide a finished label.

For label 170, cleaner portion 190 can be delivered to a thermal print head by replacing one of the label portions on the thermal label roll with a cleaner material. The thermal label printer may use known standard positioning technology to skip printing on the label position that contains the cleaner material.

It should be apparent that cleaner material 160 is incorporated in thermal paper roll 110 or thermal label 170 and functions to maintain clean thermal print heads without the need to ensure compliance with a cleaning process involving separate cleaning materials. Cleaner material 160 is a special section of thermal paper roll 110 or thermal label 170. Thermal paper roll 110 or thermal label 170 is self-cleaning by virtue of including a section of cleaning material at one or more places within the thermal paper roll 110 or the thermal label 170.

Special sections of cleaning material may be positioned at the beginning or the end of thermal paper roll 110 or thermal label 170, or they may be distributed periodically throughout the roll or label (such as shown in FIGS. 3 and 4 and FIGS. 5 and 6, for examples). The special sections may or may not be printable in the normal thermal printing manner. Accordingly, the thermal printer may or may not segregate the cleaning sections from the rest of the thermal paper roll 110 or the thermal label 170. Firmware associated with the thermal printer may be modified to provide an optimum cleaning result.

It should also be apparent that cleaner material 160 provides an automatic cleaning process without any human intervention while a thermal roll, such as a thermal paper roll or a thermal label roll, are being used. This cleaning process is transparent to a customer using the thermal roll or an operator of the thermal printer. The result is improved print quality and more readable receipts for customers.

It should further be apparent that special sections of cleaner material 160 have physical characteristics that remove debris from a thermal print head. These special sections may be abrasive in nature or may incorporate special chemicals to facilitate the cleaning process.

It should also be apparent that not every thermal roll in a box of thermal rolls needs the cleaning capability described hereinabove. Since cleaning is normally performed only once per box of several thermal rolls, it is conceivable that this concept may be practiced by adding a single thermal roll with cleaning capability to each case of thermal rolls.

Although the above description describes cleaner material 160 being applied to printable roll products such as thermal paper rolls, and printable sheet products such as individual labels, it is conceivable that cleaner material 160 may be applied to other than printable roll or sheet products, such as printable fanfold products. By incorporating cleaner material 160 within a printable product, printer cleaning is made easier and compliance with the cleaning process is assured.

While the present invention has been illustrated by the description of example processes and system components, and while the various processes and components have been described in detail, applicant does not intend to restrict or in any way limit the scope of the appended claims to such detail. Additional modifications will also readily appear to those skilled in the art. The invention in its broadest aspects is therefore not limited to the specific details, implementations, or illustrative examples shown and described. Accordingly, departures may be made from such details without departing from the spirit or scope of applicant's general inventive concept.

What is claimed is:

1. A thermal media comprising:

a substrate having a front side and a back side opposite the front side;

a thermally-sensitive coating disposed on the front side of the substrate, wherein portions of the thermally-sensitive coating are adapted to be imaged by a thermal print heat to provide receipt information as the substrate moves past the thermal print head; and a cleaner material disposed on a portion of the thermally-sensitive coating and adapted to perform cleaning of a thermal printhead when the cleaner coating moves past the thermal printhead.

2. Thermal media according to claim 1, wherein the cleaner material comprises an adhesive material which provides tack to remove buildup of residue and dust from a thermal print head to clean the thermal print head.

3. Thermal media according to claim 1, wherein the cleaner material comprises an abrasive material which scrubs buildup of residue and dust from a thermal print head to clean the thermal print head.

4. Thermal media according to claim 1, wherein the cleaner material comprises a high caliper material which increases pressure on the thermal roll to provide a cleaning action on a thermal print head when the high caliper material moves past the thermal print head.

5. Thermal media according to claim 1, wherein the cleaner material comprises a high surface tension material with a high contact angle to attract buildup from a thermal print head to clean the thermal print head.

6. Thermal media according to claim 1, wherein the cleaner material comprises a micro encapsulated material.

7. Thermal media according to claim 6, wherein the microencapsulated material comprises isopropyl alcohol (IPA).

8. Thermal media according to claim 6, wherein the microencapsulated material comprises D-limonene.

9. Thermal media according to claim 1, wherein the cleaner material comprises microencapsulated capsules which deliver cleaning chemicals to a thermal print head to clean the thermal print head when heat is applied to the microencapsulated capsules.

10. Thermal media according to claim 1, wherein the cleaner material comprises microencapsulated capsules which deliver cleaning chemicals to a thermal print head to clean the thermal print head when pressure is applied to the microencapsulated capsules.

11. Thermal media according to claim 1, wherein the cleaner material comprises nanoparticles which provide an optimized cleaning surface against which a thermal print head can be cleaned.

12. Thermal media according to claim 11, wherein the nanoparticles comprise at least one of silica nanomaterials, carbonate-based nanomaterials, and carbon nanotubes.

13. Thermal media according to claim 1, further comprising:

a core; and a web having a longitudinally-extending axis and wound on the core along the axis, the web including the substrate, the thermally-sensitive coating, and the cleaner material.

14. Thermal media according to claim 13, wherein the core is coated with a chemical which impregnates inner layers of the web over time to properly position chemicals of the cleaning material for cleaning a thermal print head.

15. Self-cleaning thermal media comprising:

a core; and a web having a longitudinally-extending axis and wound on the core along the axis, the web including (i) a substrate having a front side and a back side opposite the front side, (ii) a thermally-sensitive coating disposed on the front side of the substrate, and (iii) a cleaner material disposed on a portion of the thermally-sensitive coating, wherein the cleaner material functions to perform self-cleaning of a thermal print head, without using separate materials, when the cleaner material moves past the thermal print head.

16. A method of manufacturing self-cleaning thermal media, the method comprising:

applying a thermally-sensitive coating on a front side of the substrate; and applying a cleaner material on a portion of the thermally-sensitive coating such that the cleaner material performs self-cleaning of a thermal print head when the cleaner material moves past the thermal print head.

17. A method according to claim 16, wherein applying a cleaner material on a portion of the thermally-sensitive coating includes spraying the cleaner material on the portion of the thermally-sensitive coating.

18. A method according to claim 16, wherein applying a cleaner material on a portion of the thermally-sensitive coating includes splicing a cleaning card to the thermal media.

19. A method according to claim 16, wherein the thermal media comprises a thermal paper roll.

20. A method according to claim 16, wherein the thermal media comprises a thermal label roll.

* * * * *